US006882272B2

(12) United States Patent
Pfefferseder et al.

(10) Patent No.: US 6,882,272 B2
(45) Date of Patent: Apr. 19, 2005

(54) DANGER DETECTING SYSTEM

(75) Inventors: Anton Pfefferseder, Sauerlach-Arget (DE); Torsten Meyer-Staufenbiel, Neuried (DE); Bernd Siber, Glonn (DE); Andreas Hensel, Vaihingen (DE); Ulrich Oppelt, Zorneding (DE)

(73) Assignee: Robert Bosch GmbH, Stuttgart (DE)

( * ) Notice: Subject to any disclaimer, the term of this patent is extended or adjusted under 35 U.S.C. 154(b) by 310 days.

(21) Appl. No.: 10/158,737

(22) Filed: May 30, 2002

(65) Prior Publication Data

US 2002/0180598 A1 Dec. 5, 2002

(30) Foreign Application Priority Data

Jun. 2, 2001 (DE) ..... 101 27 057

(51) Int. Cl.[7] ..... G08B 23/00; G08B 26/00; G08B 29/00

(52) U.S. Cl. ..... 340/531; 340/500; 340/505; 340/514; 340/518; 340/693.6

(58) Field of Search ..... 340/500, 505–506, 340/514, 518, 531, 693.6, 693.9, 693.11, 693.12; 345/14

(56) References Cited

U.S. PATENT DOCUMENTS

| | | | | | |
|---|---|---|---|---|---|
| 4,459,582 A | * | 7/1984 | Sheahan et al. | ..... | 340/539.16 |
| 4,535,401 A | * | 8/1985 | Penn | ..... | 700/3 |
| 5,105,370 A | * | 4/1992 | Shaw et al. | ..... | 340/577 |
| 5,117,219 A | * | 5/1992 | Tice et al. | ..... | 340/518 |
| 5,194,846 A | * | 3/1993 | Lee et al. | ..... | 340/505 |
| 5,405,254 A | | 4/1995 | Hennessy et al. | | |
| 5,510,725 A | * | 4/1996 | Schantz et al. | ..... | 324/768 |
| 5,831,546 A | | 11/1998 | Costa et al. | | |
| 6,094,134 A | | 7/2000 | Cohen | | |
| 6,535,121 B1 | * | 3/2003 | Matheny | ..... | 340/506 |

FOREIGN PATENT DOCUMENTS

| | | |
|---|---|---|
| DE | 40 11 728 A1 | 10/1991 |
| DE | 297 18 102 U1 | 1/1998 |
| EP | 0 174 804 A1 | 3/1986 |
| EP | 0 940 790 A2 | 9/1999 |
| GB | 2 195 041 A | 3/1988 |
| WO | 93/05619 | 3/1993 |

* cited by examiner

*Primary Examiner*—Jeffery Hofsass
*Assistant Examiner*—Lam Pham
(74) *Attorney, Agent, or Firm*—Michael J. Striker

(57) ABSTRACT

A danger detecting system has a danger detecting control center, at least one detector, at least one conductor connecting the danger detecting control center with the at least one detector, the danger detecting control center producing an output signal depending on a signal of the detector, the danger detecting control center being composed of a plurality of modules, a bus through which the modules are connected, the danger detecting control center and the modules being formed so that the modules are mountable and/or dismountable during an operation of the danger detecting control center.

7 Claims, 3 Drawing Sheets

DANGER DETECTING SYSTEM

BACKGROUND OF THE INVENTION

The present invention relates to danger detecting systems.

U.S. Pat. No. 5,117,219 discloses a smoke and fire detection system which has a CPU and is connected through a bus with individual modules each module forms correspondingly an interface unit to detection lines.

SUMMARY OF THE INVENTION

Accordingly, it is an object of the present invention to provide a danger warning system which is a further improvement of the existing systems of this type.

In keeping with these objects and with others which will become apparent hereinafter, one feature of the present invention resides, briefly stated, in a danger warning system which has a danger detecting control center; at least one detector; at least one conductor connecting said danger detecting control center with said at least one detector; said danger detecting control center producing an output signal depending on a signal of said detector, said danger detecting control center being composed of a plurality of modules; a bus through which said modules are connected, said danger detecting control center and said modules being formed said modules are mountable and/or dismountable during an operation of said danger detecting control center.

The inventive danger detecting system designed in accordance with the present invention has the advantage that the modules during the operation of the danger detecting control center can be mountable and dismountable, so that the danger detecting control center must not be turned off during an exchange or an expansion. This enormously increases the user friendliness of a danger detecting control center. Furthermore, it is not necessary to perform a reset to introduce new modules into the danger detecting control center. Due to the modular construction of the danger detecting control center it is possible to adapt a danger detecting control center for corresponding customers, located for example in different countries. The subdivision of functions for the modules can be performed so that for each application and for each regulation a suitable, quasi dimensionally tailored center can be assembled. For exchange of the module it is necessary that the danger detecting control center runs further, so that the operation of the danger detecting control center is guaranteed. This is especially of an eminent advantage in security-critical systems, such as airports, where an uninterrupted monitoring is required.

It is especially advantageous when the danger detecting control center has an optical bus as the internal bus. This has the advantage that for individual modules, in particular field bus modules such as LSN (Local Security Network) a galvanic separation to the central system is required. With the use of an optical bus, the bus is available with the galvanic separation. Furthermore, an optical bus system has a very robust solution which is less error-sensitive. The danger of an electromagnetic influence of the module is significantly lower when no transmission cable extends outwardly. The optical transmission therefore has significant advantages. Also, charge and discharge currents during plugging the module with a danger of destruction of the modules are avoided. Also, static voltages which can occur during removal and insertion of the module are excluded. This makes possible simple dismounting and simple mounting of the module during the operation.

Furthermore, it is advantages when the modules are mountable in the danger detecting control center by a snapping mounting, wherein mounting of the signal connection to the bus is also realized. Therefore, the mounting methods are provided such that a mounting of the module makes possible the arrangement of the connection of the internal bus of the danger detecting control center.

Moreover, it is advantages when the danger detecting control centers are connected with one another, so that the danger detecting control centers can share various modules, since this allows engagement of their modules by foreign danger detecting control centers. By joining of the danger detecting control centers it is possible to build an extremely complex system, for example for monitoring of large installations, such as airports.

Moreover, it is advantageous when the danger detecting control centers are designed with different modules, such as an energy supply module, an interface module, an ethernet module, or a field bus module. The ethernet module serves for example for joining of the danger detecting control centers. Furthermore, the connection to a management system for monitoring of the total installation is possible. Moreover the connection to the internet is possible to enable a remote maintenance and monitoring.

Ethernet is a network standard in accordance with IEEE802.3 and operates either with coaxial cables or twisted pair cables (twisted conductors). Typically ethernet operates with 10 Mbit/s or 100 Mbit/s, and in future also with higher data rates. The ethernet module is for example a module for interlinking the control centers. The use of the ethernet standards provides in particular the advantage that a simple connection to the majority of data networks of firms is possible, since their ethernet is used widely. Moreover, the corresponding components are available in a price-favorable manner. Alternatively however other standard networks or proprietary configurations are possible as well.

Furthermore, there is the advantage that the interlinked danger monitoring control centers can be accommodated in a housing, so that from outside the device operates as a single center. It is possible to operate the inter linked danger monitoring control centers in a master slave operation. Alternatively, it is possible to use a multi master system which is robust against a failure of a single module.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Danger detecting installations in general and fire detecting installations in particular can be subdivided as a rule into three operational regions: detectors, centers with control functions, and transmission devices to help-supplying locations. The detector is installed on a location. The detector recognizes the danger, for example a fire and transmits it through a field bus system to the control center. Correspondingly after the entry of the signal, the control center performs further actions. For example, in the case of an alarm, through a transmission device the fire department is informed to extinguish the fire.

The control center can perform also further control functions. For example automatically through optical and acoustic warning devices, persons in the corresponding areas can be warned. Ventilation devices, smoke dampers, extinguishing devices and fire protective doors can be controlled. Also, a plurality of functions can be provided, when for differently dimensioned structures and structure complexes also different structure control centers or danger monitoring control centers are required. The band width extends from small devices with less than 10 detectors, through medium devices such as hotels and banks with hundred or thousand detectors, to very large devices such as for example airports with for example substantially over 50,000 detectors.

There is a correspondingly great number of the associated alarm, warning and controlling functions. In accordance with the present invention a modular danger monitoring control center is provided. The danger monitoring control center is designed so that the modules are connected with one another through an internal bus which is formed here as an optical bus, and the modules during the operation of the danger monitoring control center are mountable and dismountable.

When a module during the operation is mounted in the danger monitoring control center, it is provided that on the other hand it leads to a low electrical disturbance, for example by over voltage protection and/or the use of an optical bus. On the other hand the module is joined with the danger monitoring control center, wherein in some cases software is installed on the central computer of the danger monitoring control unit, so that the new module is controllable. It can be alternatively provided that the danger monitoring control unit already has the corresponding software or loads it through the internet. With removal of a module during the operation it is further provided, for example by monitoring circuits that this does not lead to over voltages. The central monitoring control unit then recognizes, for example by polling through the internal bus, that the module was removed.

Figure 1:
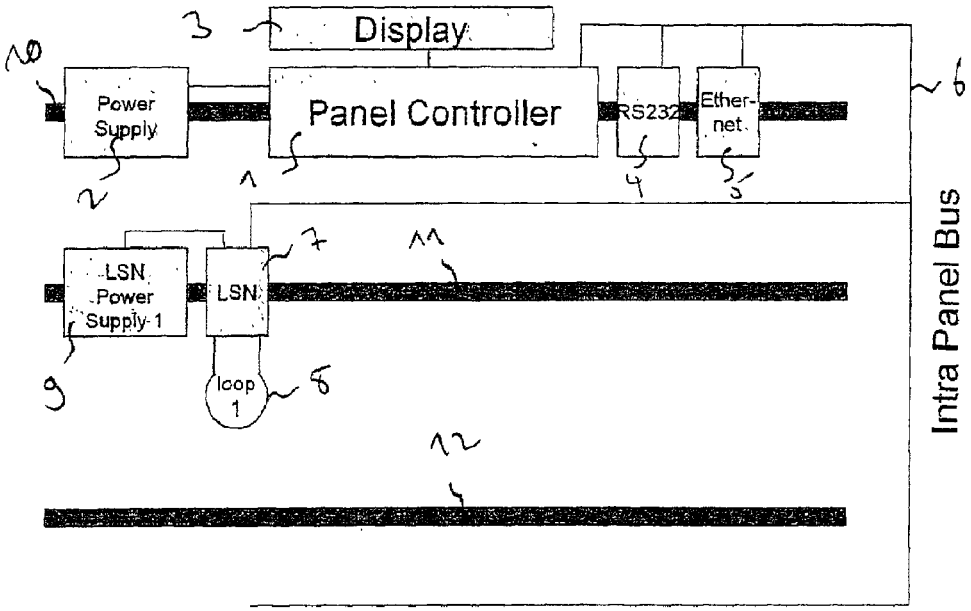
FIG. 1 is a view showing an embodiment of a small detection control center in a modular construction.

FIG. 1 shows a danger monitoring control center, here a fire monitoring control center in a modular construction. A panel controller 1 is connected with a display 3 through a data conductor. The panel controller 1 is mounted on a plate 10 in the danger monitoring control unit. Through a data input/output the panel controller 1 is connected with an internal bus 6 of the danger monitoring control center. This internal bus 6 is here formed as an optical bus. Since it deals with an optical bus, the panel controller 1 has an optical transmitter, for example a light emission diode, and an optical receiver for example a photo diode.

For transmission of data the corresponding module connected with the bus 6 emits with the corresponding transmitter a light in an optical transmission medium, and the transmission medium sends this light to all other modules in the danger detecting control center which are connected to the optical transmission medium. The modules receive the light with the photodiode and evaluate the informations. For the transmission, an intensity modulation of the light is utilized, however also a pulse width modulation is possible.

It is important to design the optical transmission medium so that the light which is emitted from any module can reach all other modules. As the optical transmission medium various substances can be used. For example, glass fibers, polymer phases, plexiglass rods, plexiglass plates or other shaped transparent bodies, inwardly mirrored pipes or semi-pipes or also the environmental air can be utilized. A further possibility is the linear bundling of the LED light by a rectangular rod profile. The emitted light is projected along a line, and the receiver must be arranged on this line.

The panel controller 1 is supplied with its electrical energy from a power supply device 2 identified here as a power supply. A further module 4 and a further module 5 on the strip 10 are connected to the bus 6. The module 4 is an RS 232 module or in other words an interface module, which represents a serial interface. The module 5 here is an ethernet module or in other words an interconnecting module which serves for interconnection with other danger detecting control centers or for connection to the internet.

A power supply unit 9 and a field bus module 7 are arranged on a further strip 11 of the danger detecting control center. The power supply unit 9 here identified as an LSN power supply, supplies the field bus module 7 which is identified here as LSN (Local Security Network) with electrical energy. The LSN field bus module 7 has a loop 8 identified as loop 1 and represents an LSN bus. Various detectors, such as smoke and fire detectors or other detectors are connected to the LSN bus 8. The LSN field bus module 7 is furthermore connected to the internal bus 6 of the danger detecting control center.

The internal bus 6 leads to further processing modules, such as for example a computer or a transmission module which can transmit a message to a help location, such as for example a fire department. This is not shown here for the sake of simplification. A strip 12 of the danger detecting control center is here not occupied. It deals here with a relatively small danger detecting control center.

The panel controller 1 takes also the functions of the main control. Through the RS 232 module 4 the selection device for the alarm transmission is connected to a fire department. Through the internet module 5 a connection is provided to a firm-LAN (Local Area Network). Moreover, the control center is connected through the display 3 with the operator unit. On the field bus module 7, up to 127 detectors can be connected to the LSN bus.

Figure 2:
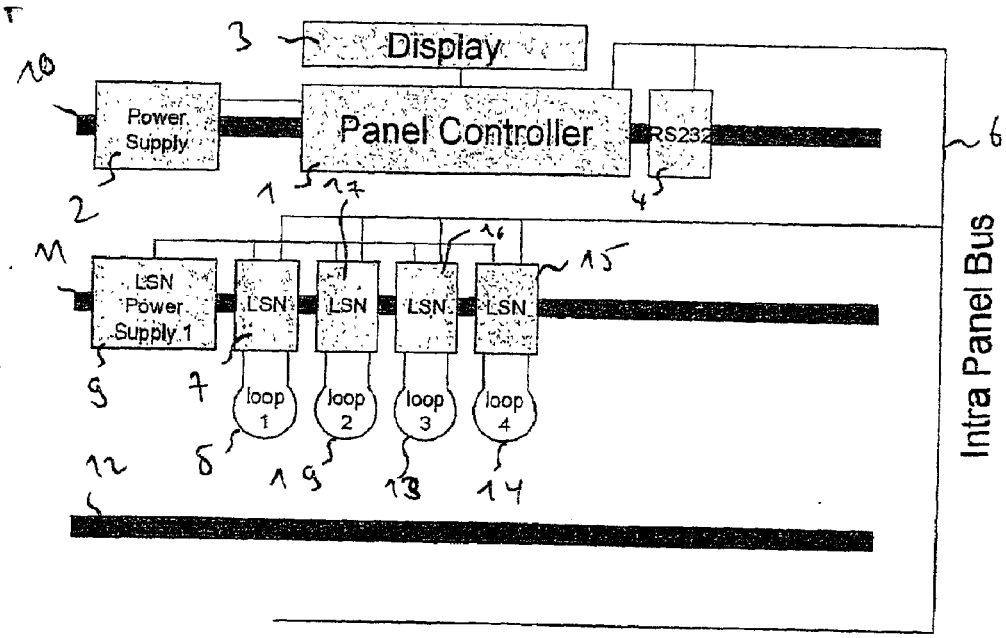
FIG. 2 is a view showing a first embodiment of a fire detector control fire detecting control center in a modular construction with up to 508 detectors.

FIG. 2 shows a fire detecting control center formed as a danger detecting control center in a modular construction for up to 508 detectors. On the strip 10 also the power supply device 2, the panel controller 1 and the RS 232 module 4 are arranged. The panel controller 1 is moreover connected with the display 3. The panel controller 1 and the RS 232 module 4 are connected to the bus 6. Also, the power supply unit 9 and the field bus module 7 are arranged on the strip 11. However, further field bus modules 15, 16 and 17 can also be available on the strip 11, with LSN buses 14, 13 and 19, which identified here with loops 2, 3, and 4. The power supply unit 9 supplies electrical energy to the field bus modules 7, 17, 16 and 15. All field bus modules 17 and 15 up to 17 are connected to the bus 6. The strip 12 again remains unoccupied.

It is shown here how by the joining of several field bus modules it is possible to increase the number of the detectors to be controlled. Sometimes more than one RS232 interface is needed, when further functions such as described herein below are performed. After mounting of corresponding modules, a simple printer, a further modem, external operator units or similar devices can be connected.

Figure 3:
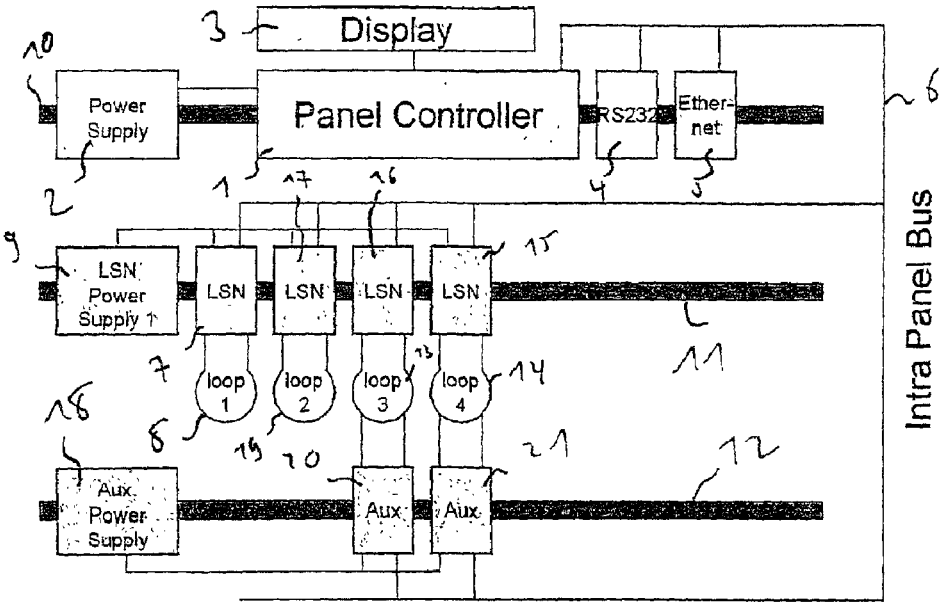
FIG. 3 is a view showing a second embodiment of a fire detecting control center in a modular construction for up to 508 detectors.

FIG. 3 shows a fire detecting control center in a modular construction for up to 508 detectors. Moreover, on the strip 10 the power supply unit 2, the panel controller 1, the RS 232 and the ethernet module 4 and 5 are provided, wherein the panel controller 1, the RS 232 module 4 and the ethernet module 5 are connected to the bus 6. On the strip 11 moreover the power supply unit 9 and the field bus modules 7, 15, 16, 17 with the connected LSN buses 8, 19, 13, and 14 are provided. The field busses 13 and 14 are connected with auxiliary voltage source modules 20 and 21 which are arranged on the strip 12. The field bus modules 17, 15–17 are connected to the bus 6.

The auxiliary voltage modules 20 and 21 are supplied from a power supply unit 18 which is also arranged on the strip 12. This auxiliary voltage sources 20 and 21 transmit energy through pair of wires which are connected with the LSN buses 13 and 14 to consumers with high energy consumption, for example signal transmitters or flashlights. This energy supply is switchable through the modules 20 and 21.

Figure 4:
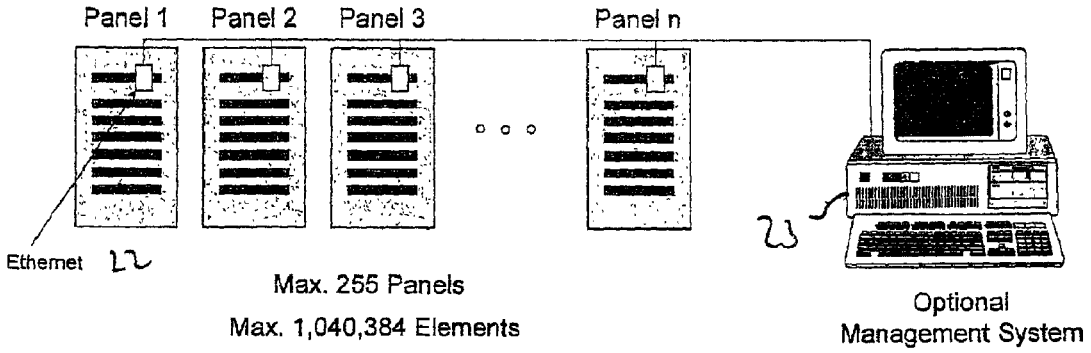
FIG. 4 is a view showing a cluster of several control centers which are connected with one another and with a management system through ethernet.

FIG. 4 shows a cluster of several control centers which are connected themselves with the management system. The panels 1, 2, 3, and n control all danger detecting control centers which are connected through an ethernet unit and connected to a management system 23. Maximum 255 panels can be connected here through an Mio detectors to the management system 23. The management system 23 serves for monitoring the whole installation. Moreover, a connection to the internet is possible.

Figure 5:
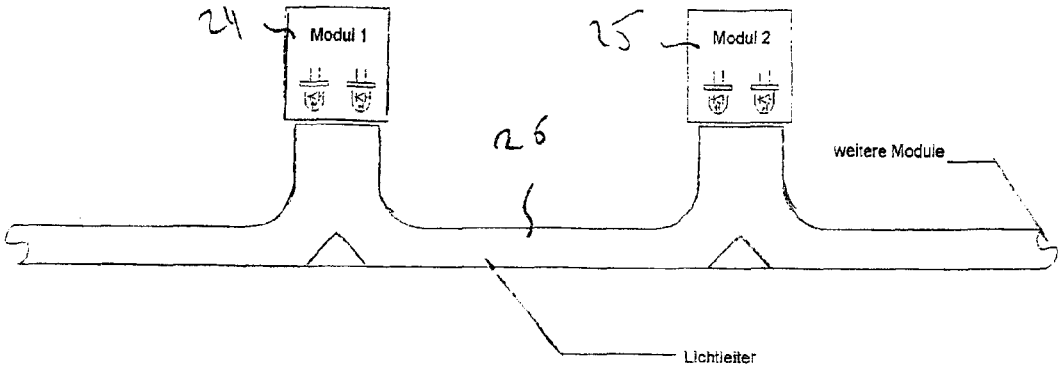
FIG. 5 is a view showing two modules on an optical bus system in the danger monitoring control center.

FIG. 5 shows how two modules 24 and 25 of the inventive danger detecting control center are connected to an optical bus 26 which is formed here as a light conductor. The bus system 26 receives all modules 24 and 25, when one module transmits and determines whether the corresponding message for it is intended. It is a multi-master system, in which either each module is associated with a time window for transmission or an arbitration is performed.

The arbitration means a competition of the module, which one must transmit. Here different messages have different priorities. The message with the highest priority passes in the arbitration and therefore must be transmitted. With this bus structure a redundancy is provided. When for example one module fails, then with the bus structure it has the only influence that the operations which are associated with the failed module are no longer available, but the basic functionality remains operational. Thus, for example, a field bus module as an output module can provide, in the case of an alarm, a predetermined transmission command.

For optical data transmission over short tracks the so-called IrDA standard is provided. In it the optical data transmission is defined between two points, point to point. For bus system this method can not be directly transferred. However, an extension of the transmission protocol is possible, so that IrDA is also bus-capable. In this way the IrDA hardware can use transmission and reception blocks for the above described optical bus system. The components are used in great numbers in information technology and therefore are available at favorable prices. Also, a greater part of the available IrDA transmission software can be utilized. It is especially advantageous that the optical bus system for the fire detecting devices can be defined analogously to IrDA.

Figure 6:
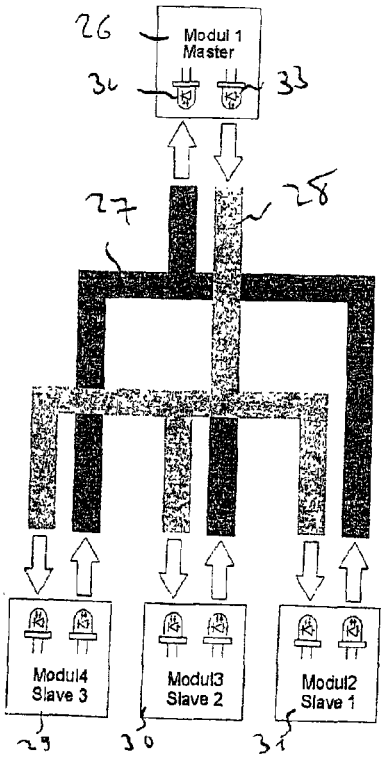
FIG. 6 is a view showing arrangements with a master module and several slave modules (point to multipoint).

Alternatively it is possible to provide interconnection of the modules in a danger detecting control center in a master-slave-system. FIG. 6 shows such a configuration. A master 26 is connected through a separate conductor 27 with slave modules 29, 30 and 31. They have a conductor 28 for transmission, which is connected to the master 26 for its reception. The master has a light transmitter 32 and a light receiver 33. The light transmitter can be formed as a LED or a laser diode, and the receiver 33 can be formed as a photodiode or bolometer or a light cell.

It will be understood that each of the elements described above, or two or more together, may also find a useful application in other types of constructions differing from the types described above.

While the invention has been illustrated and described as embodied in danger warning system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A danger detecting system, comprising a danger detecting control center; at least one detector; at least one conductor connecting said danger detecting control center with said at least one detector; said danger detecting control center producing an output signal depending on a signal of said detector, said danger detecting control center being composed of a plurality of modules; a bus through which said modules are connected said danger detecting control center and said modules being formed so that said modules are mountable and/or dismountable during an operation of said danger detecting control center, and wherein upon mounting during en operation of said danger detecting control center, a signal connection to said bus is realized.

2. A danger detecting system as defined in claim 1, wherein said bus has an optical bus.

3. A danger detecting system as defined in claim 1, wherein said modules are formed so that they are mountable by a snap mounting.

4. A danger detecting system as defined in claim 1, wherein said danger detecting control center includes an energy supply module, an interface module, an Ethernet module, and a field bus module.

5. A danger detecting system, comprising a danger detecting control center; at least one detector; at least one conductor connecting said danger detecting control center with said at least one detector; said danger detecting control center producing an output signal depending on a signal of said detector, said danger detecting control center being composed of a plurality of modules; a bus through which said modules are connected, said danger detecting control center and said modules being formed so that said modules are mountable and/or dismountable during an operation of said danger detecting control center, and wherein upon mounting during an operation of said danger detecting control center, a signal connection to said bus is realized; and another such danger detecting control center, said danger detecting control centers being formed so that a first one of the danger detecting control centers provides access to a module of a second one of said danger detecting control centers, when said first and second danger detecting control centers are interconnected through a corresponding interconnecting module.

6. A danger detecting system as defined in claim 5, and further comprising a housing in which said interconnected danger detecting control centers are accommodated.

7. A danger detecting system as defined in claim 5, wherein said interconnected danger detecting control centers are operable in a master slave operation.

* * * * *